US008050589B2

(12) United States Patent
Okabe

(10) Patent No.: US 8,050,589 B2
(45) Date of Patent: Nov. 1, 2011

(54) TANDEM-TYPE PROCESS UNIT REMOVABLY LOADED IN IMAGE FORMING DEVICE

(75) Inventor: Yasushi Okabe, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 64 days.

(21) Appl. No.: 12/407,086

(22) Filed: Mar. 19, 2009

(65) Prior Publication Data

US 2009/0324275 A1 Dec. 31, 2009

(30) Foreign Application Priority Data

Jun. 27, 2008 (JP) ..... 2008-168155

(51) Int. Cl.
*G03G 15/00* (2006.01)

(52) U.S. Cl. ..... 399/90; 399/111

(58) Field of Classification Search ..... 399/90, 399/107, 110–114, 116, 117
See application file for complete search history.

(56) References Cited

U.S. PATENT DOCUMENTS

| | | | | |
|---|---|---|---|---|
| 6,061,537 | A | 5/2000 | Nakajima et al. | |
| 6,721,521 | B2 | 4/2004 | Kataoka et al. | |
| 6,944,415 | B2 | 9/2005 | Nomura | |
| 7,315,711 | B2 * | 1/2008 | Ariizumi et al. | 399/149 |
| 7,493,061 | B2 * | 2/2009 | Hatori et al. | 399/111 |
| 7,720,405 | B2 * | 5/2010 | Okabe | 399/90 |
| 2004/0022556 | A1 | 2/2004 | Nomura | |
| 2007/0071482 | A1 | 3/2007 | Okabe | |
| 2007/0160380 | A1 | 7/2007 | Imaizumi et al. | |
| 2007/0160384 | A1 | 7/2007 | Sakurai et al. | |
| 2007/0286632 | A1 | 12/2007 | Okabe | |
| 2008/0159775 | A1 * | 7/2008 | Koishi et al. | 399/90 |

FOREIGN PATENT DOCUMENTS

EP 1939697 A1 7/2008

(Continued)

OTHER PUBLICATIONS

Extended EP Search Report dtd Oct. 16, 2009, EP Appln. 09003885.2-2209.

(Continued)

*Primary Examiner* — Hoan Tran
(74) *Attorney, Agent, or Firm* — Banner & Witcoff, Ltd.

(57) ABSTRACT

A tandem type of process unit removably loaded in an image forming device has a plurality of process cartridges, a pair of lower supporting plates, and a pair of upper supporting plates. Each of the plurality of process cartridges has a photosensitive drum rotatably about an axis extending in a first direction. Each of the plurality of process cartridges has two side faces facing each other in the first direction and a cartridge electrode provided on the side face. The plurality of process cartridges is aligned in a second direction perpendicular to the first direction. Each of the lower supporting plates supports a lower part of the side face of each of the plurality of process cartridges. The pair of upper supporting plates is positioned upward and separately from the pair of lower supporting plates. Each of the upper supporting plates supports an upper part of the side face of each of the plurality of process cartridges. The pair of upper support plates and the pair of lower support plates provide a side opening facing the side face of each of the plurality of process cartridges to expose the electrode of each of the plurality of process cartridges toward outside through the side opening.

40 Claims, 10 Drawing Sheets

FOREIGN PATENT DOCUMENTS

| | | | |
|---|---|---|---|
| JP | 11-174772 | A | 7/1999 |
| JP | 11-344905 | A | 12/1999 |
| JP | 2001-249517 | | 9/2001 |
| JP | 2003-280313 | A | 10/2003 |
| JP | 2005-156915 | A | 6/2005 |
| JP | 2007-213018 | A | 8/2007 |
| JP | 2007-213033 | | 8/2007 |

OTHER PUBLICATIONS

JP Office Action dtd Apr. 27, 2010, JP Appln. 2008-168155, English translation.

* cited by examiner

TANDEM-TYPE PROCESS UNIT REMOVABLY LOADED IN IMAGE FORMING DEVICE

CROSS REFERENCE TO RELATED APPLICATIONS

This application claims priority from Japanese Patent Application No. 2008-168155 filed Jun. 27, 2008. The entire content of this priority application is incorporated herein by reference.

TECHNICAL FIELD

The present invention relates to an image forming apparatus such as a color printer, and a tandem-type process unit attached thereto.

BACKGROUND

In electrophotographic color printers, so-called tandem-type color printers have become the mainstream, in which photosensitive drums corresponding to colors of yellow, magenta, cyan, and black, are arranged in parallel.

Among these tandem-type color printers, Japanese Patent Application Publication No. 2007-313033 discloses a printer in which process cartridges corresponding to the respective colors as a whole are detachably attached to the main unit of the printer. Each of the process cartridges includes a photosensitive drum and a developer which are contained together in a case for each color. The process cartridges of the respective colors are placed on a tray which is detachably attached to the main unit. On a side of the tray, intermediate electric contacts corresponding to the respective process cartridges are provided. In a state that the process cartridges are placed on the tray, the cartridge electric contact of each process cartridge is connected to the corresponding intermediate electric contact. The printer main unit includes main-unit electric contacts to be connected to the respective intermediate electric contacts in a state that the tray has been attached to the main unit. The respective cartridge electric contacts and the respective intermediate electric contacts are mechanically connected, and the respective intermediate electric contacts and the main-unit electric contacts are mechanically connected at the same time. As a result, the respective cartridge electric contacts and the respective main-unit electric contacts are electrically connected through the respective intermediate electric contacts. In the state that the respective cartridge electric contacts and the main-unit electric contacts are electrically connected, power can be supplied from the main unit to the respective process cartridges.

However, the structure of the tray side becomes complicated when the above intermediate electric contacts are provided.

Therefore, an object of the present invention is to provide a tandem-type process unit having a simple structure.

SUMMARY

The present invention features a tandem type of process unit removably loaded in an image forming device, having a plurality of process cartridges, a pair of lower supporting plates, and a pair of upper supporting plates. Each of the plurality of process cartridges has a photosensitive drum rotatably about an axis extending in a first direction. Each of the plurality of process cartridges has two side faces facing each other in the first direction and a cartridge electrode provided on the side face. The plurality of process cartridges is aligned in a second direction perpendicular to the first direction. Each of the lower supporting plates supports a lower part of the side face of each of the plurality of process cartridges. The pair of upper supporting plates is positioned upward and separately from the pair of lower supporting plates. Each of the upper supporting plates supports an upper part of the side face of each of the plurality of process cartridges. The pair of upper support plates and the pair of lower support plates provide a side opening facing the side face of each of the plurality of process cartridges to expose the electrode of each of the plurality of process cartridges toward outside through the side opening.

The present invention features an image forming device having a main unit, and a tandem type of process unit removably loaded in the main unit. The tandem type of process unit further includes a plurality of process cartridges, a pair of lower supporting plates, and a pair of upper supporting plates. Each of the plurality of process cartridges has a photosensitive drum rotatably about an axis extending in a first direction. Each of the plurality of process cartridges has two side faces facing each other in the first direction and a cartridge electrode provided on the side face. The plurality of process cartridges is aligned in a second direction perpendicular to the first direction. Each of the lower supporting plates supports a lower part of the side face of each of the plurality of process cartridges. The pair of upper supporting plates is positioned upward and separately from the pair of lower supporting plates. Each of the upper supporting plates supports an upper part of the side face of each of the plurality of process cartridges. The pair of upper support plates and the pair of lower support plates provide a side opening facing the side face of each of the plurality of process cartridges to expose the cartridge electrode of each of the plurality of process cartridges toward outside through the side opening.

The present invention features a tandem type of process unit removably loaded in an image forming device having a plurality of process cartridge, a pair of lower supporting plates, and a pair of upper supporting plates. Each of the plurality of process cartridge has a photosensitive drum rotatably about an axis extending in a first direction, the rotating shaft having two ends. Each of the plurality of process cartridge has two side faces facing each other in the first direction. The plurality of process cartridge is aligned in a second direction perpendicular to the axial direction. Each of the lower supporting plates supports a lower part of the side face of each of the plurality of process cartridge. The pair of upper supporting plates is positioned separately and upward from the pair of lower supporting plates. Each of the upper supporting plates supports an upper part of the side face of each of the plurality of process cartridges.

BRIEF DESCRIPTION OF THE DRAWINGS

The particular features and advantages of the invention as well as other objects will become apparent from the following description taken in connection with the accompanying drawings, in which.

DETAILED DESCRIPTION

Figure 1:
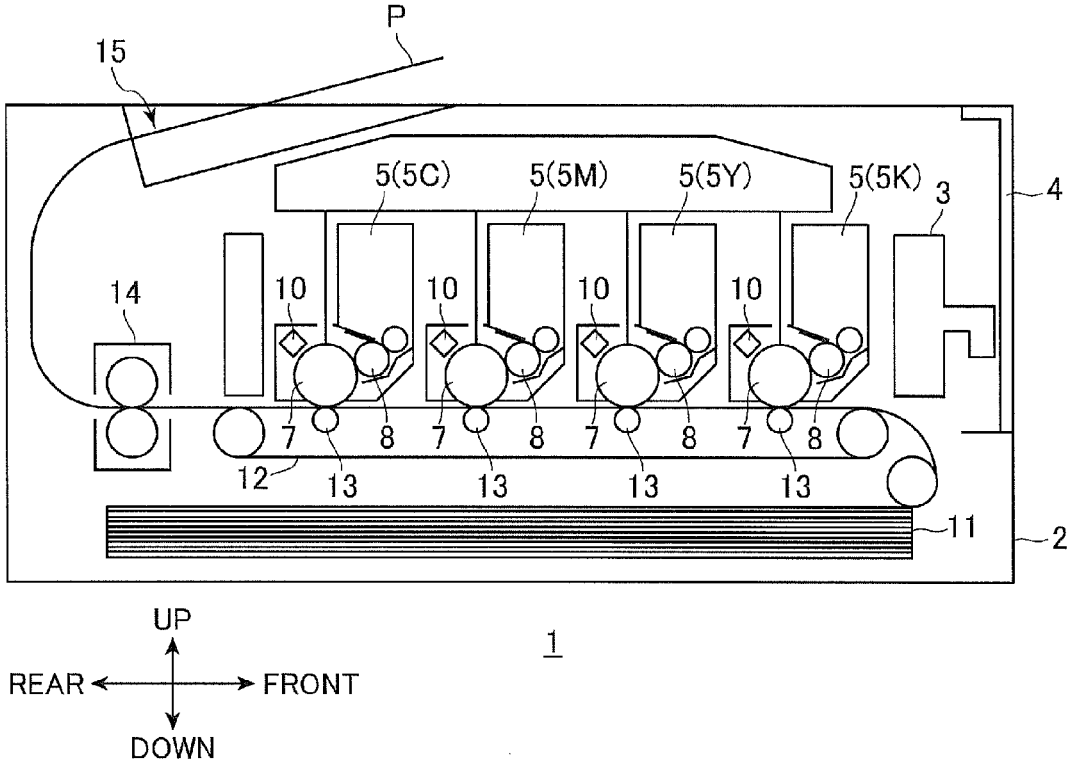
FIG. 1 is a side view showing a color printer according to a first embodiment of the present invention.

Embodiments of the present invention will be described in detail with reference to the accompanying drawings. In the description to follow, the expressions "front", "rear", "up", "left" and "right" are used throughout the description to define the various parts when the printer is disposed in an orientation in which it is intended to be used. Specifically, the side where the front cover 4 is provided (right side in FIG. 1) is "front" and the opposite side (left side in FIG. 1) is "rear". The right-left direction is synonymous with the width direction. From a directional point of view, the tandem-type process unit 3 is described in a state that the tandem-type process unit 3 has been attached to the main unit 2 unless explicitly written otherwise.

1. Structure of Color Printer

An image forming apparatus according to one embodiment of the present invention is provided as a tandem-type color printer 1. The color printer 1 has a main unit 2. The main unit 2 includes a tandem-type process unit 3. The main unit 2 has a front cover 4 on one side thereof so that the tandem-type process unit 3 is loaded and unloaded in the main unit 2 through the front cover 4.

The tandem-type process unit 3 includes four process cartridges 5. The process cartridges 5 are aligned in parallel at regular intervals in the front-rear direction. The process cartridges 5 (5K, 5Y, 5M, 5C) correspond to colors of black, yellow, magenta, and cyan arranged from the front in the mentioned order. Above the tandem-type process unit 3, an exposure unit 6 is provided to emit four beams of laser light corresponding to the respective colors. Instead of the exposure unit 6, four LED arrays corresponding to the respective process cartridges 5 may be provided.

Each of the process cartridges 5 includes a photosensitive drum 7, a developing roller 8, and a scorotron charger 10. As the photosensitive drum 7 rotates about an axis, the surface of the photosensitive drum 7 is evenly electrified by the scorotron charger 10. The surface of the photosensitive drum 7 is then selectively exposed to the laser beams emitted from the exposure unit 6. This exposure forms an electrostatic latent image on the surface of the photosensitive drum 7. When the photosensitive drum 7 further rotates and the electrostatic latent image faces the developing roller 8, the developing roller 8 supplies toner to the electrostatic latent image so as to form a toner image on the surface of the photosensitive drum 7.

The main unit 2 further includes a sheet cassette 11 for holding recording sheets P, at a bottom portion thereof. Each recording sheet P held in the sheet cassette 11 is fed onto a paper-feeder belt 12 by a plurality of rollers. The paper-feeder belt 12 faces the four photosensitive drums 7 from the lower side of the drums. A transfer roller 13 is provided to face each photosensitive drum 7 through the paper-feeder belt 12. As the paper-feeder belt 12 runs, the recording sheet P on the paper-feeder belt 12 sequentially passes between the paper-feeder belt 12 and the respective photosensitive drums 7. When the respective photosensitive drums 7 face the recording sheet P, the toner images carried on the surfaces of the photosensitive drums 7 are transferred onto the recording sheet P by transfer bias applied to the transfer roller 13.

A fixing unit 14 is disposed downstream of the paper-feeder belt 12 in a feeding direction of the recording sheet P. The recording sheet P on which the toner images have been transferred is fed to the fixing unit 14. In the fixing unit 14, the toner images are fixed onto the recording sheet P by heat and pressure. The recording sheet P on which the toner images have been fixed is ejected by a plurality of rollers to a sheet discharge tray 15 provided at a top portion of the main unit 2.

2. Tandem Type of Process Unit (1) Process Cartridge

Figure 2:
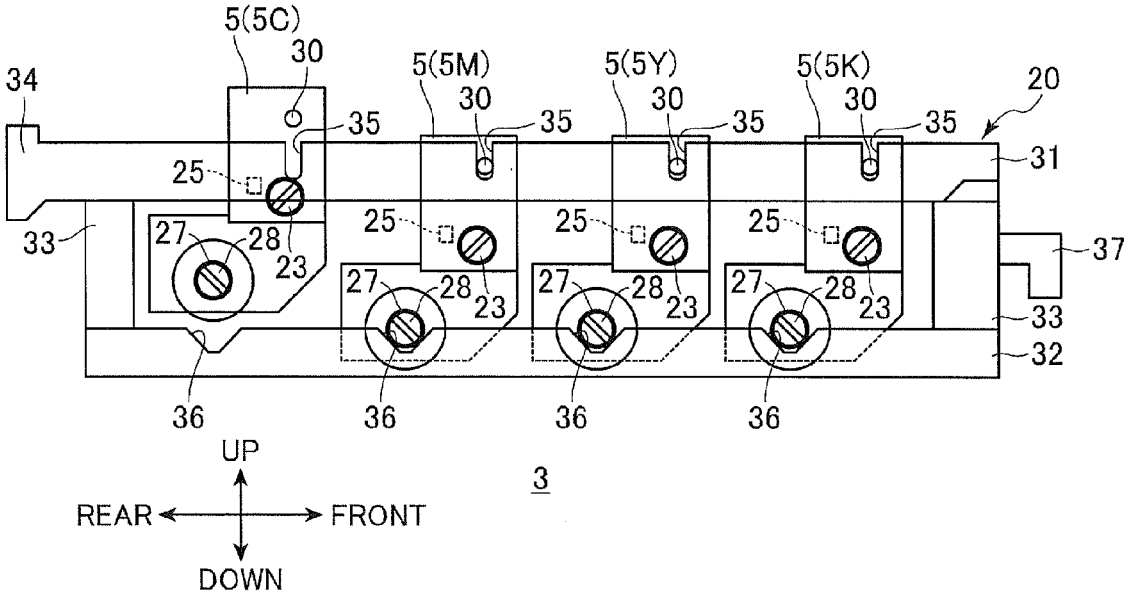
FIG. 2 is a side view showing a tandem type of process unit.

Referring to FIG. 2, each process cartridge 5 is formed into a substantial L-shape as viewed from a side. Each process cartridge 5 includes toner corresponding to the respective colors, in addition to the corresponding photosensitive drum 7 and the corresponding developing roller 8 (see FIG. 1). An opening is provided at a bottom portion of each process cartridge 5 so that a peripheral surface of the photosensitive drum 7 is partially exposed from the opening.

A development driving input portion 23 for transferring drive force to the developing roller 8 is provided on the left side wall of each process cartridge 5.

On the right side wall of each process cartridge 5, a cartridge electrode 25 is provided.

On both side walls of each process cartridge 5, projecting parts 27 are formed respectively as cylindrical lower supported portions. The projecting parts 27 have a center axis which is on the axis of the photosensitive drum 7. The respective projecting parts 27 project outward from the respective side walls of the process cartridge 5 in the width direction. The distance between the end surfaces 27*a* of the pair of projecting parts 27 is larger than the distance between the outer surfaces 32*a* of a pair of lower supporting plates 32 which will be described later. Alternatively, the distance between the end surfaces 27*a* of the pair of projecting parts 27 is larger than the distance between the inner surfaces 32*b* of the pair of lower supporting plates 32.

As shown in FIG. 2, an input gear 28 for transferring a drive force to the photosensitive drum 7 is provided on the projecting part 27 on the left side wall of each process cartridge 5.

Boss members 30 project outward in the width direction from top end portions of both side walls of each process cartridge 5. The boss member 30 is used for supporting the process cartridge 5 to upper supporting plates 31, which will be described later. The distance between the end surfaces 30*a* of the pair of boss members 30 is larger than the distance between inner surfaces 31*b* of the pair of upper supporting plates 31.

(2) Unit Frame

Referring to FIG. 2, the tandem-type process unit 3 includes a unit frame 20 which supports the four process cartridges 5 together.

The unit frame 20 includes the pair of upper supporting plates 31 facing each other in the width direction; the pair of lower supporting plates 32 arranged at distances and downward from the pair of upper supporting plates 31; and a pair of joint plates 33 facing each other in the front-rear direction.

Each upper supporting plate 31 is formed into a rectangular shape extending in the front-rear direction as viewed from a side. The front end of each upper supporting plate 31 has a shorter length than a length of a middle portion thereof in the vertical direction. The rear end of each upper supporting plate 31 has a longer length than that of the middle portion thereof in the vertical direction, thereby forming a stopper portion 34 extending in the vertical direction.

Each upper supporting plate 31 has four notches 35 whose upper portions are open, formed into substantial U-shapes as viewed from a side. The four notches 35 are arranged at regular intervals in the front-rear direction. The boss member 30 of each process cartridge 5 is engaged in t h e corresponding notch 35. As a result, each boss member 30 is supported by the corresponding notch 35 in the front-rear direction. The respective boss members 30 of the four process cartridges 5 are supported by the respective notches 35 so that the four process cartridges 5 are supported together by the pair of upper supporting plates 31.

Each lower supporting plate 32 is formed into a rectangular plate extending in the front-rear direction as viewed from a side. Each lower supporting plate 32 is shorter than each upper supporting plate 31 in the front-rear direction. The pair of lower supporting plates 32 faces each other at a distance shorter than the distance between the pair of upper supporting plates 32. In another embodiment, the pair of lower supporting plates 32 may be positioned at a first center-to-center distance which is shorter a second center-to-center distance between the upper supporting plates 31.

Each lower supporting plate 32 has four notches 36 whose upper portions are open, formed into substantial V-shapes as viewed from a side. The four notches 36 are arranged at regular intervals in the front-rear direction. The projecting part 27 of each process cartridge 5 is engaged in the corresponding notch 36 from above. As a result, each projecting part 27 is supported by the corresponding notch 36 from beneath. The respective projecting parts 27 of the four process cartridges 5 are supported by the respective notches 36 so that the four process cartridges 5 are supported together by the pair of lower supporting plates 32.

The joint plates 33 are formed into substantially rectangular plates extending both in the vertical direction and in the width direction as viewed from the rear. Each joint plate 33 is jointed to the pair of upper supporting plates 31 and the pair of lower supporting plates 32 from inside in the width direction.

The front joint plate 33 is positioned in front of the four process cartridges 5. A unit handle 37 formed into a substantial L-shape as viewed from a side is provided at a front portion of the front joint plate 33.

Figure 3:
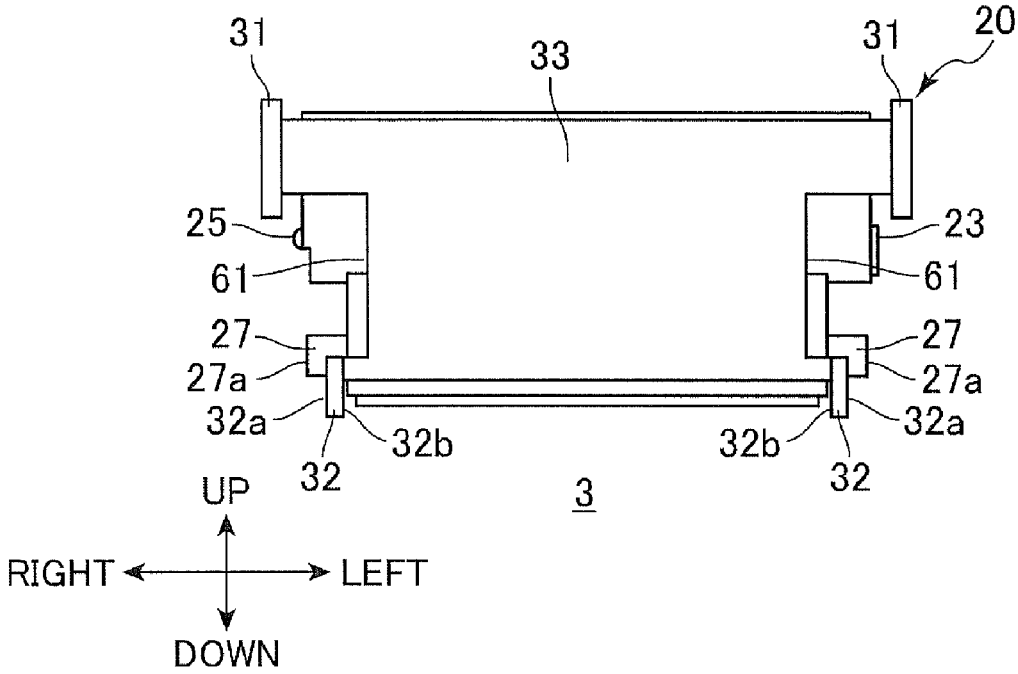
FIG. 3 is a back view showing the process unit of FIG. 2.

The rear joint plate 33 is positioned behind the four process cartridges 5. As shown in FIG. 3, the rear joint plate 33 has a narrower middle portion 61 which is positioned between the portion joined with the pair of upper supporting plates 31 and the portion joined with the pair of lower supporting plates 32. The portion 61 has a shorter width than the distance between the inner surfaces of the pair of upper supporting plates 31 in the width direction. As a result, the rear joint plate 33 is constricted in the middle in the vertical direction due to the middle portion 61.

(3) Attachment of Process Cartridge

Each process cartridge 5 is attached to and removed from the tandem-type process unit 3, in a state that the tandem-type process unit 3 has been removed from the main unit 2.

In the state that the tandem-type process unit 3 has been removed from the main unit 2, each process cartridge 5 is movable in the tandem-type process unit 3 without being fixed thereto. Specifically, as shown in FIG. 2, the boss member 30 of each process cartridge 5 is engaged in the corresponding notch 35 of each upper supporting plate 31 of the tandem-type process unit 3. Each projecting part 27 of each process cartridge 5 is also engaged in the corresponding notch 36 of each lower supporting plate 32 of the tandem-type process unit 3. As a result, each process cartridge 5 is removably supported both on the pair of upper supporting plate 31 and on the pair of the lower supporting plates 32.

When each process cartridge 5 is attached to the tandem-type process unit 3, each boss member 30 and each projecting part 27 are engaged in the corresponding notch 35 and the corresponding notch 36 from above respectively, while the process cartridge 5 is being guided between the pair of upper supporting plates 31. As a result, each process cartridge 5 is supported by the pair of upper supporting plates 31 and the pair of lower supporting plates 32, thereby finishing an attachment to the tandem-type process unit 3.

3. Internal Structure of Main Casing

Figure 4:
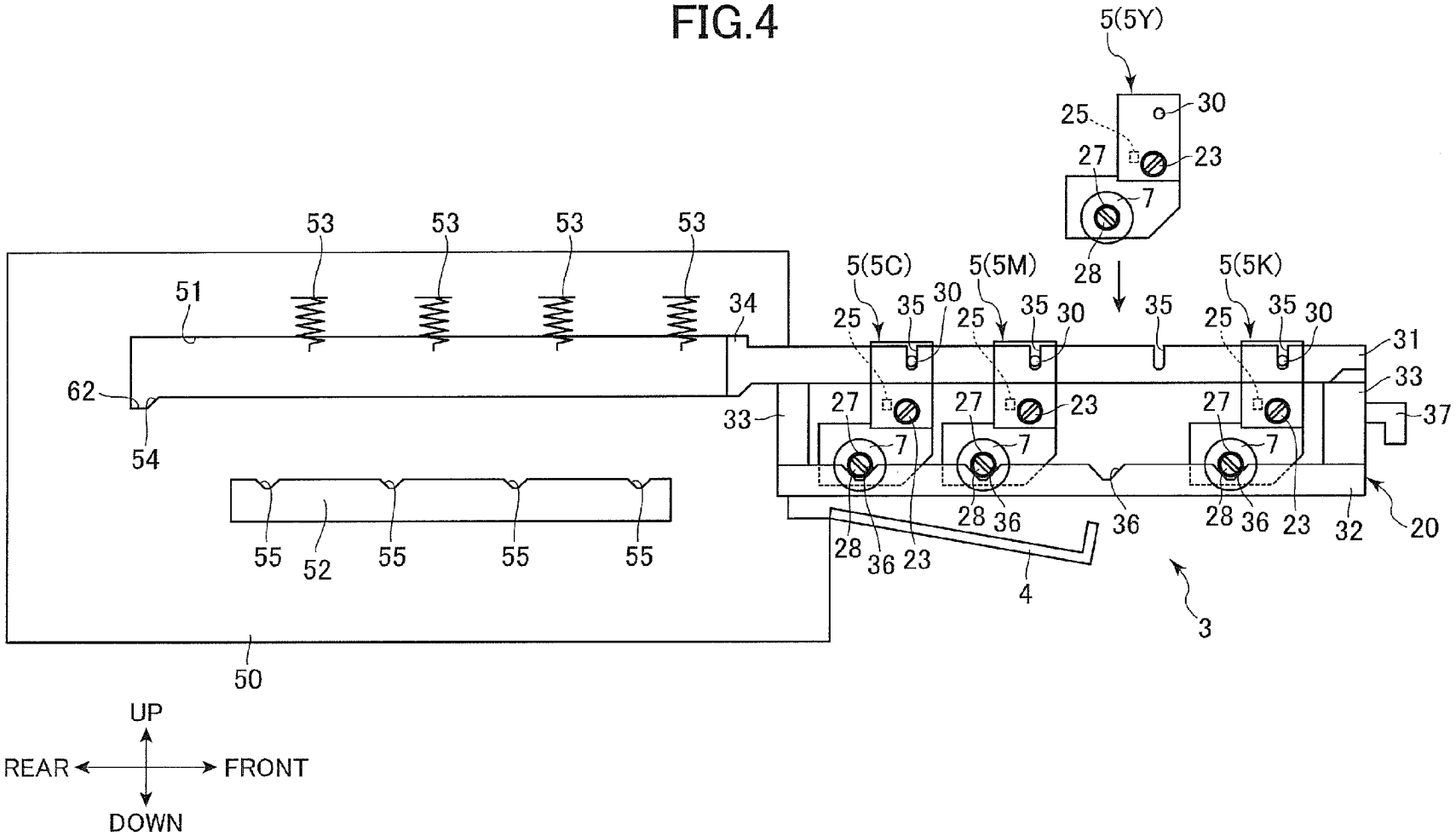
FIG. 4 is a side view showing a process unit unloaded from a main unit of a color printer.

As shown in FIG. 4, the main unit 2 includes a pair of main-unit side plates 50 facing each other at a distance therebetween in the width direction (only the right main-unit side plate 50 is shown in FIG. 4). Each main-unit side plate 50 includes a guiding rail 51 extending in the front-rear direction; a pair of positioning members 52 for positioning each process cartridge 5 with respect to the main unit 2; and pressing members 53 for pressing each process cartridge 5 to the corresponding positioning member 52.

Figure 7:
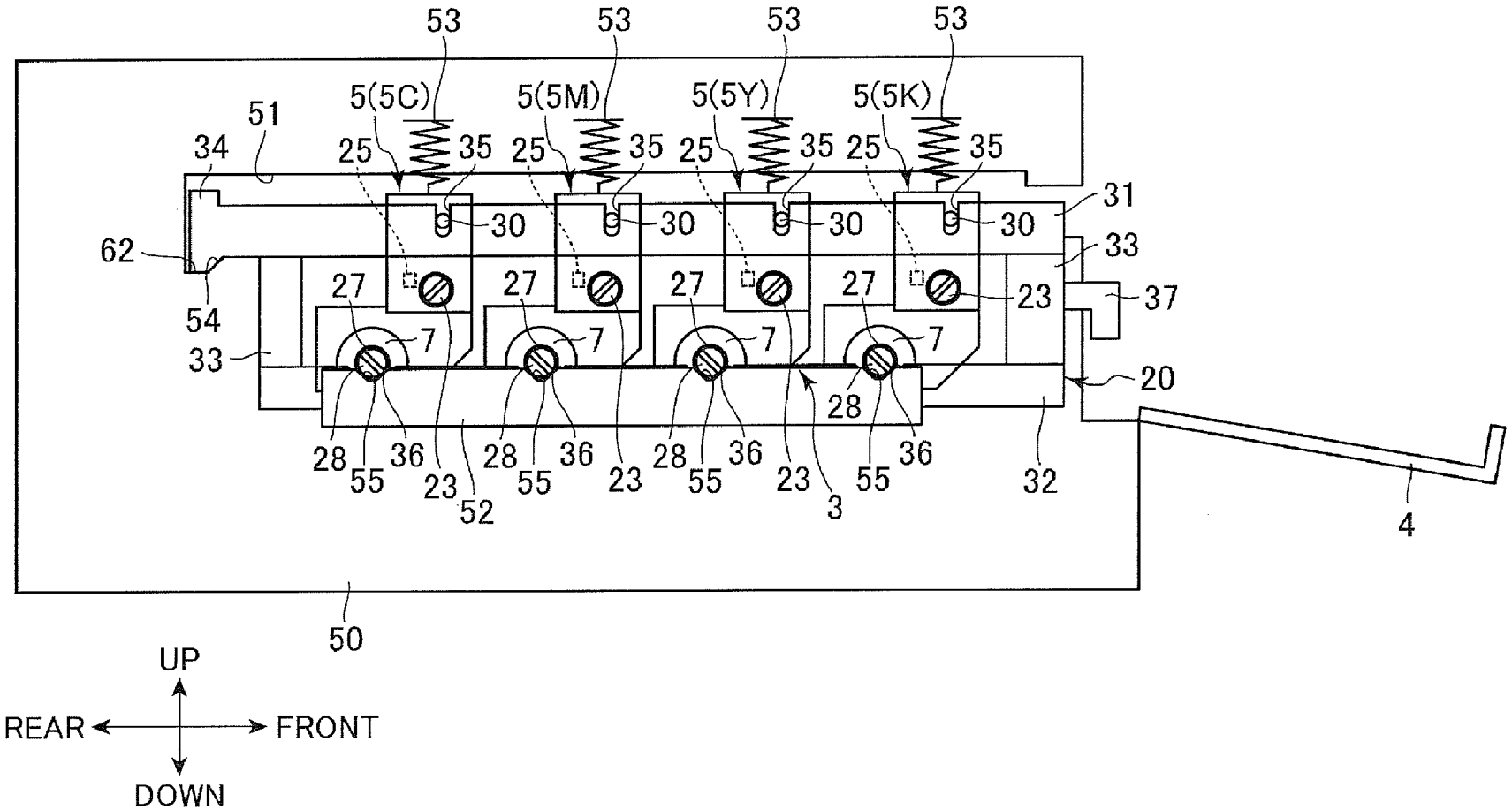
FIG. 7 is a side view showing a process unit loaded in a main unit of a color printer.

For example, each guiding rail 51 is formed by deforming the corresponding main-unit side plate 50 outward in the width direction. As shown in FIG. 7, each guiding rail 51 is open to the front, and the front end of the guiding rail 51 has a narrower length than the length of rear end thereof in the vertical direction. The rear end of each guiding rail 51 includes an inclined face 54 having a lower edge inclined downward and rearward; and a flat face 62 extending from the edge of the inclined face 54 to the rear edge. The rear end of each guiding rail 51 has a longer length than the length of the stopper portion 34 of each upper supporting plate 31 in the vertical direction. The middle portion of each guiding rail 51 between the front and rear ends thereof has the almost same length as that of the stopper portion 34 of each upper supporting plate 31 in the vertical direction.

Figure 5:
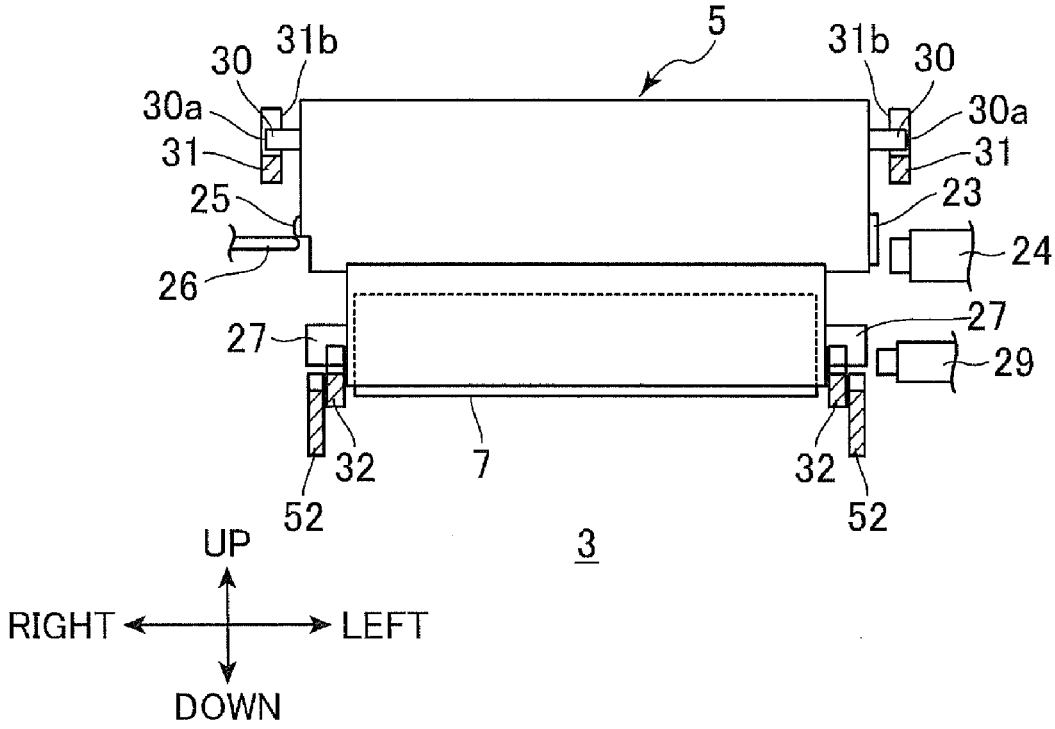
FIG. 5 is a back view showing the process unit of FIG. 4.

As shown in FIG. 5, the pair of positioning members 52 face each other at a distance in the width direction. As shown in FIG. 4, each positioning member 52 is formed into a substantially rectangular plate extending in the front-rear direction. Each positioning member 52 is positioned outside of the corresponding lower supporting plate 32 in the front-rear direction, in a state that the tandem-type process unit 3 has been attached to the main unit 2.

Each positioning member 52 has four positioning grooves 55 whose upper portions are open, formed into a substantial V-shape as viewed from a side. The four positioning grooves 55 are arranged at regular intervals in the front-rear direction, specifically, at the same interval as the notches 36 so that each positioning groove 55 faces the corresponding notch 36 in the width direction when the tandem-type process unit 3 has been loaded in the main unit 2.

As shown in FIG. 7, pressure members 53 are formed from coil springs and provided to correspond to the respective process cartridges 5. One end of the pressure member 53 is fixed to the top panel of the main unit 2. The other lower end of the pressing member 53 is in contact with the corresponding process cartridge 5 from above to press the process cartridge 5 downward when the tandem-type process unit 3 has been loaded in the main unit 2.

Figure 8:
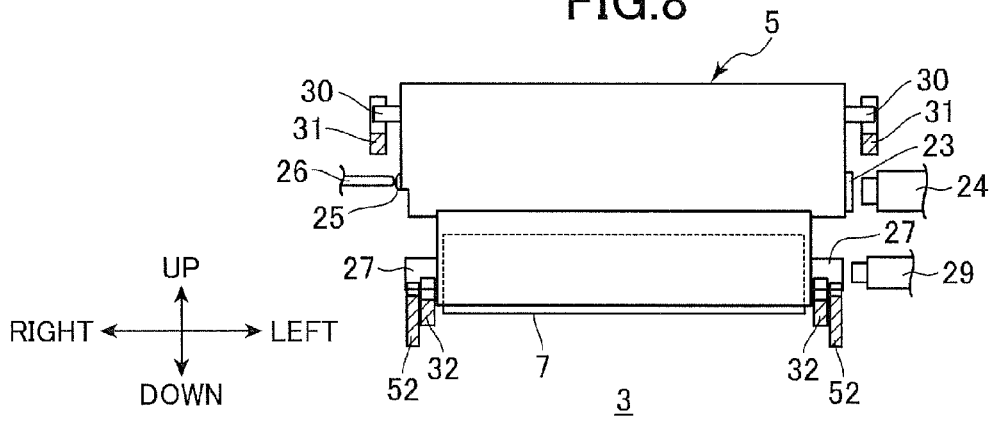
FIG. 8 is a back view showing the process unit of FIG. 7.

As shown in FIGS. 5 and 8, the main unit 2 includes development driving output portions 24 and drum driving output portions 29 so as to transfer a drive force to the process cartridges 5. Each development driving output portion 24 and each drum driving output portion 29 correspond to each process cartridge 5. In the state that the tandem-type process unit 3 has been loaded in the main unit 2, the development driving output portion 24 and the drum driving output portion 29 corresponding to each process cartridge 5 face the corresponding development driving input portion 23 and the corresponding the drum development driving input portion 28 of the process cartridge 5, respectively. Each development driving output portion 24 and each drum driving output portion 29 are joined with the corresponding development driving input portion 23 and the corresponding drum development driving input portion 28 respectively, so that drive force for rotating the photosensitive drum 7 and the developing roller 8 is transferred to the corresponding process cartridge 5 through the joined portions of the development driving output portion 24 and the drum driving output portion 29.

The main unit 2 also includes main-unit electrodes 26 for supplying electric power to the process cartridges 5. Each main-unit electrode 26 corresponds to the cartridge electrode 25 of each process cartridge 5. As shown in FIGS. 5 and 8, the end of each main-unit electrode 26 is positioned inside of the pair of upper supporting plates 31 in the width direction, as the main unit 2 is viewed from above. In the state that the tandem-type process unit 3 has been loaded in the main unit 2, each main-unit electrode 26 comes into contact with the corresponding cartridge electrode 25 of the process cartridge 5 from the right in the width direction. As a result, each main-unit electrode 26 and the corresponding cartridge electrode 25 are electrically and mechanically connected, thereby supplying electric power to the process cartridge 5 through the main-unit electrode 26 and the cartridge electrode 25.

4. Attachment of Tandem-Type Process Unit

As shown in FIG. 4, in the state that the tandem-type process unit 3 has been removed from the main unit 2, the stopper portion 34 of each upper supporting plate 31 is positioned on a front end portion of the guiding rail 51. Each guiding rail 51 has the front end portion shorter than each stopper portion 34 in the vertical direction. As a result, when each stopper portion 34 is drawn up to the front end portion of the corresponding guiding rail 51, the stopper portion 34 comes into contact with the front end face of the guiding rail 51, thereby preventing the tandem-type process unit 3 from being drawn out any further. In order to remove the tandem-type process unit 3 from the main unit 2, both stopper portions 34 are removed from the respective guiding rails 51.

Figure 6:
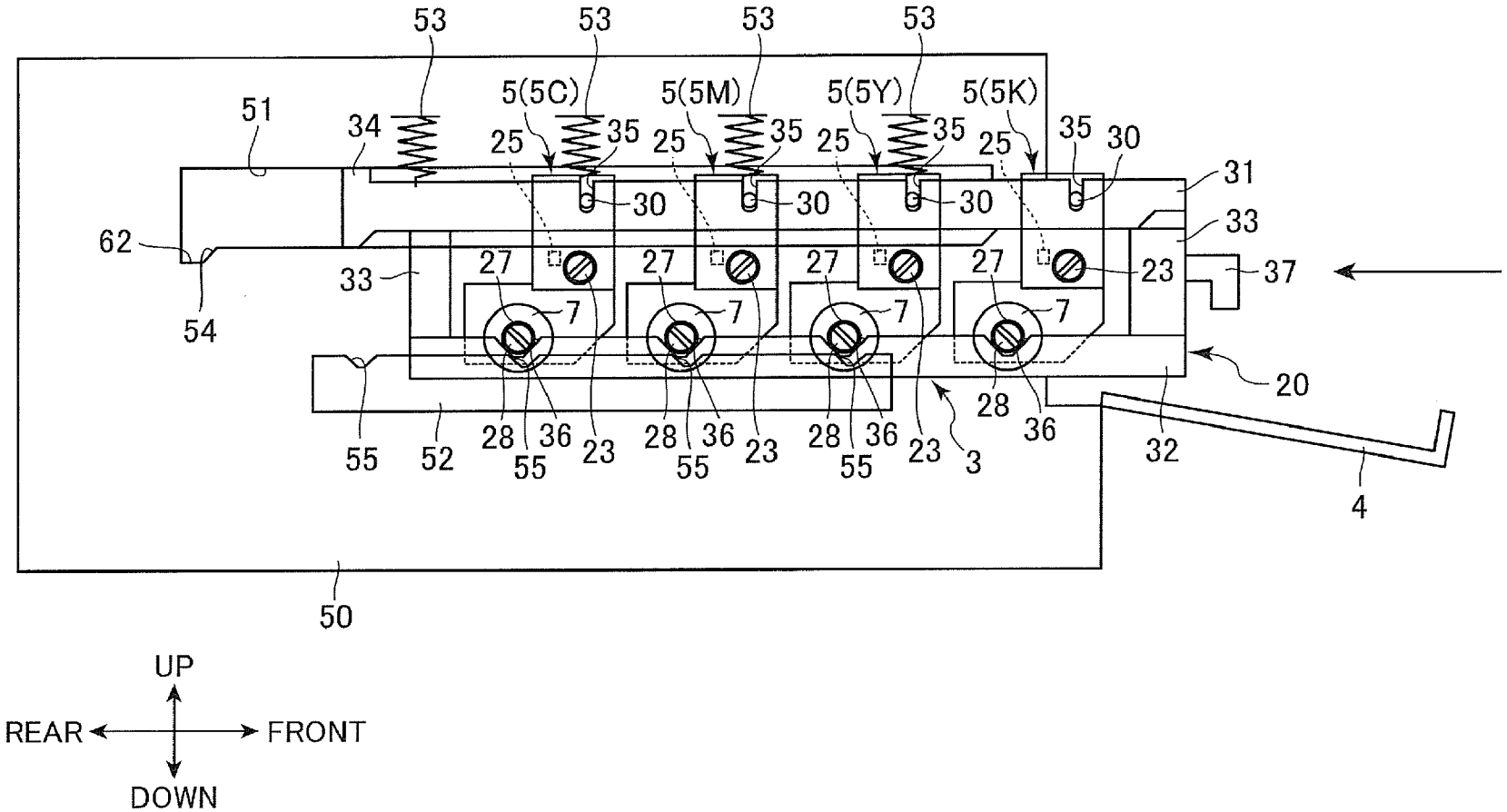
FIG. 6 is a side view showing a process unit which has been loaded in a main unit of a color printer.

As the tandem-type process unit 3 moves to the rear from the position shown in FIG. 4, the stopper portions 34 of the respective upper supporting plates 31 slide along the corresponding guiding rails 51 so that the tandem-type process unit 3 is guided into the main unit 2 as shown in FIG. 6.

As the stopper portions 34 move downward to the rear along the inclined faces 54 of the corresponding guiding rails 51, the tandem-type process unit 3 as a whole moves to one level lower downward to the rear, the projecting parts 27 of the process cartridges 5 are engaged in the corresponding positioning grooves 55 of the positioning members 52. As shown in FIG. 7, as the stopper portions 34 comes on the flat faces 62, the tandem-type process unit 3 moves to one more level lower downward to the rear, and the projecting parts 27 are removed from the corresponding notches 36 of the lower supporting plates 32. As a result, the projecting parts 27 of the process cartridges 5 are passed from the corresponding notches 36 of the lower supporting plates 32 to the corresponding positioning grooves 55 of the positioning members 52.

On the other hand, the pressing member 53 is in contact with the corresponding process cartridge 5 from above to press the process cartridge 5 from above. As a result, the projecting parts 27 of the process cartridges 5 are pressed into the corresponding positioning grooves 55, thereby positioning the respective process cartridges 5 with respect to the main unit 2. The loading of the tandem-type process unit 3 in the main unit 2 has thus completed.

The lower end of each pressing member 53 has a member having a face convex downward, for example. As a result, as the tandem-type process unit 3 slides along the guide rails 51, the lower end of each pressing member 53 smoothly gets on the top face of the corresponding process cartridge 5, and smoothly gets off the top face thereof.

As mentioned above, the four process cartridge 5 including the respective photosensitive drums 7 are arranged in parallel in the direction orthogonal to the axial directions of the photosensitive drums 7 (front-rear direction). The upper supporting plates 31 are arranged on both sides of the process cartridges 5 in the width direction. The lower supporting plates 32 are arranged below the respective upper supporting plates 31. The four process cartridges 5 are supported together both by the pair of upper supporting plates 31 and by the pair of lower supporting plates 32.

Each upper supporting plate 31 is positioned at a distance from the corresponding lower supporting plate 32 in the vertical direction. Therefore, each side of each process cartridge 5 in the width direction exposes outside through a side opening between the corresponding supporting plate 31 and the lower supporting plate 32. Therefore, by using the opening between the upper supporting plate 31 and the corresponding lower supporting plate 32, the cartridge electrode 25 of each process cartridge 5 and the corresponding main-unit electrode 26 of the main unit 2 are exposed toward outside from the opening so as to be directly connected mechanically and electrically. This configuration can remove an intermediate electrode for relaying the electric connection between the cartridge electrode 25 and the corresponding main-unit electrode 26. Furthermore, by using the side opening between each upper supporting plate 31 and the corresponding lower supporting plate 32, the drum development driving input portion 28 provided in each process cartridge 5 is exposed toward outside from the opening so as to be directly connected to the corresponding drum driving output portion 29. This configuration can remove a through-hole provided on each side of the tandem-type process unit 3 in the width direction for passing the drum driving output portion 29 therethrough. Therefore, the configuration of each side of the tandem-type process unit 3 becomes simpler.

In this embodiment, no intermediate electrodes between the process cartridge and the main unit are required. Accordingly, a design for the positions of the cartridge electrode 25 and the corresponding main-unit electrode 26 has more flexibility, if the cartridge electrode 25 and the corresponding main-unit electrode 26 satisfy a positional relationship required to establish an electric connection.

When the mechanical connection between each cartridge electrode 25 of the process cartridge 5 and the corresponding main-unit electrode 26 of the main unit 2 is achieved, the electrical connection between the cartridge electrode 25 and the main-unit electrode 26 is also achieved. This configuration can prevent troubles from occurring about the electrical connection between each process cartridge 5 and the main unit 2.

Since the distance between the inner surfaces 31*b* of the pair of upper supporting plates 31 is longer than the distance of between the inner surfaces 32*b* of the pair of lower supporting plates 32, the upper supporting plates 31 do not interfere with the attachment of the process cartridge 5 to the pair of lower supporting plates 32. This configuration achieves a smooth attachment of the process cartridge 5 to the pair of lower supporting plates 32. In other words, since the distance of the inner surfaces 32*b* of the pair of lower supporting plates 32 is shorter than the distance of the inner surfaces 321*b* of the pair of upper supporting plates 31, the pair of lower supporting plates 32 can support each process cartridge 5 stably.

Each process cartridge 5 includes the pair of boss members 30 supported by the corresponding pair of upper supporting plates 31, and the pair of projecting parts 27 supported by the corresponding pair of lower supporting plates 32. Since the distance between the end surfaces of the pair of projecting parts 27 is longer than the distance between the outer surfaces 32*a* of the pair of lower supporting plates 32, the pair of lower supporting plates 32 can support the pair of projecting parts 27 stably. Furthermore, since the distance between the end surfaces of the pair of boss members 30 is equal to or longer than the distance between the inner surfaces of the pair of upper supporting plates 31, the pair of upper supporting plates 31 can support the pair of boss members 30 stably. Specifically, the pair of upper supporting plates 31 and the pair of lower supporting plates 32 can support the process cartridges 5 stably from below. Still furthermore, the distance between the inner surfaces of the pair of upper supporting plates 31 is longer than the distance between the end surfaces of the pair of projecting parts 27. Therefore, each projecting part 27 does not interfere with the corresponding upper supporting plate 31 when the process cartridge 5 is attached to the unit frame 20, thereby achieving a smooth attachment of the process cartridge 5 to the unit frame 20. As a result, this configuration can achieve both the stable support of the respective process cartridges 5 by the unit frame 20 and the smooth attachment of the process cartridge 5 to the unit frame 20 at the same time.

Each input gear 28 is positioned on the axis of the photosensitive drum 7. When the drive force is transferred to each input gear 28 to rotate the corresponding photosensitive drum 7 about the axis thereof, the photosensitive drum 7 is not eccentrically rotated. Therefore, the pair of lower supporting plates 32 can keep supporting the respective process cartridge 5 stably.

The joint plates 33 extending both in the vertical direction and in the width direction connect the pair of upper supporting plates 31 with the pair of lower supporting plates 32. Accordingly, the positional relation between the pair of upper supporting plates 31, the positional relation between the pair of lower supporting plates 32, and the positional relation between each upper supporting plate 31 and the corresponding lower supporting plate 32 are maintained constant.

In the rear joint plate 33, the portion 61 positioned between the portion held between the pair of upper supporting plates 31 and the portion held between the pair of lower supporting plates 32 is narrower then the distance between the inner surfaces of the pair of upper supporting plates 31. Even when the tandem-type process unit 3 is loaded in the main unit 2 from the front, each main-unit electrode 26 projecting to the corresponding process cartridge 5 rather than and below the corresponding upper supporting plate 31 in the main unit 2 does not interfere with the rear joint plate 33.

In the state that the tandem-type process unit 3 has been loaded in the main unit 2, the positioning members 52 provided in the main unit 2 support the process cartridges 5 and position the process cartridges 5 with respect to the main unit 2. As a result, the process cartridges 5 can be precisely positioned with respect to the main unit 2.

Each process cartridge 5 includes the cartridge electrode 25. On the other hand, the main unit 2 includes the main-unit electrodes 26. In the state that the tandem-type process unit 3 has been loaded in the main unit 2, each main-unit electrode 26 is directly connected to the corresponding cartridge electrode 25 from the outside of the unit frame 20 in the width direction. The portion where each main-unit electrode 26 is connected to the corresponding cartridge electrode 25 is positioned inside of the pair of upper supporting plates 31 in the width direction. Therefore, each main-unit electrode 26 can be connected to the corresponding cartridge electrode 25 easily without any intermediate electrode.

The next description will explain the second embodiment according to the present invention, referring to FIGS. 9-14. Referring to FIGS. 9-14, like elements in FIGS. 1 to 8 are identified by the same reference numerals, and their explanation will be omitted.

(1) Drum Lock Lever

Figure 9:
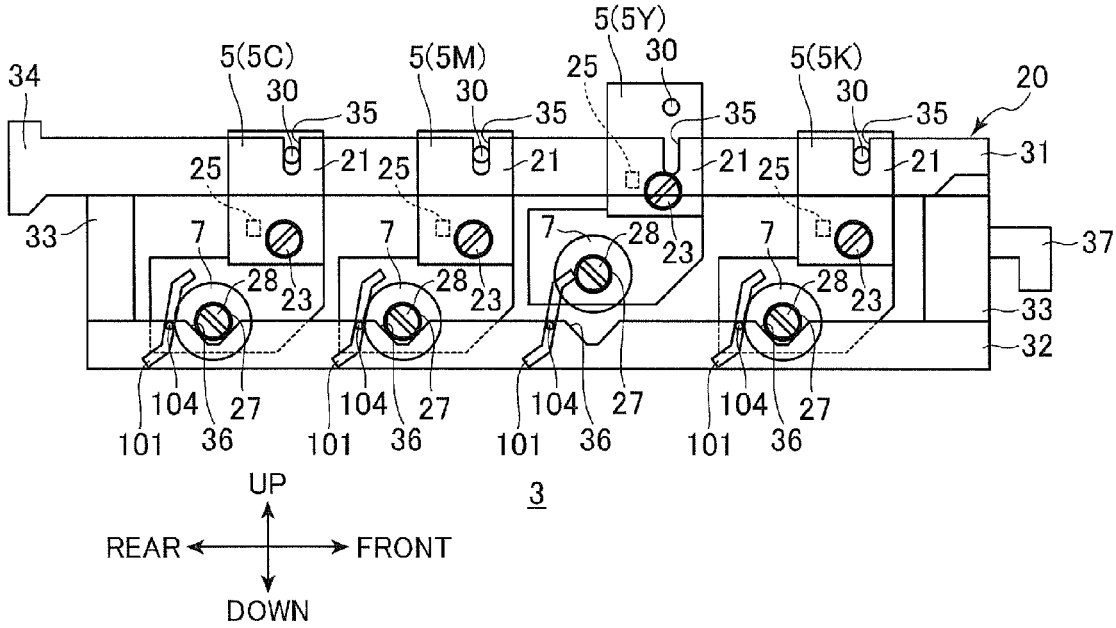
FIG. 9 is a side view showing a process unit according to a second embodiment of the present invention.
Figure 10:
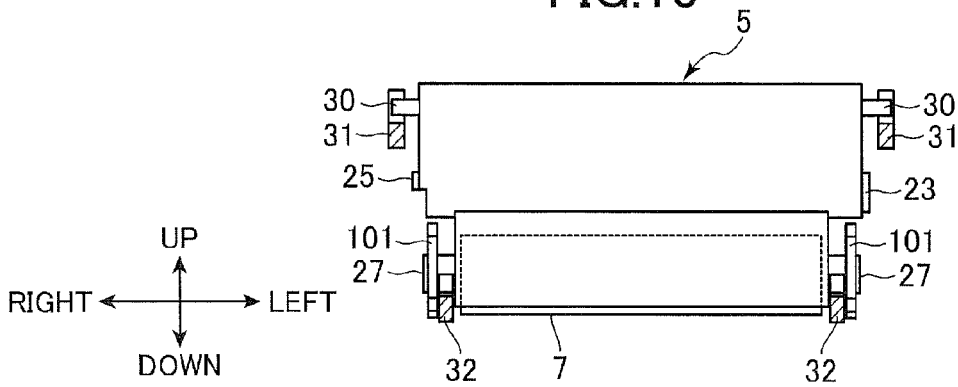
FIG. 10 is a back view showing the process unit of FIG. 9.

Referring to FIGS. 9 and 10, each lower supporting plate 32 of the unit frame 20 includes drum lock levers 101 provided behind the respective notches 36. Each drum lock lever 101 is a bar substantially bent into the shape of a crank and extending in the direction orthogonal to the width direction. Each drum lock lever 101 is pivotably supported to a supporting shaft 104 extending in the width direction and provided at a center of the lever 101. Each supporting shaft 104 is supported to the lower supporting plates 32. Each drum lock lever 101 is urged by a spring (not shown) in the counterclockwise direction as viewed from the left. In a state that no external force except the urging force is applied to the lever 101, each drum lock lever 101 is standing erect almost in the vertical direction.

(2) Cam Member

Figure 11:
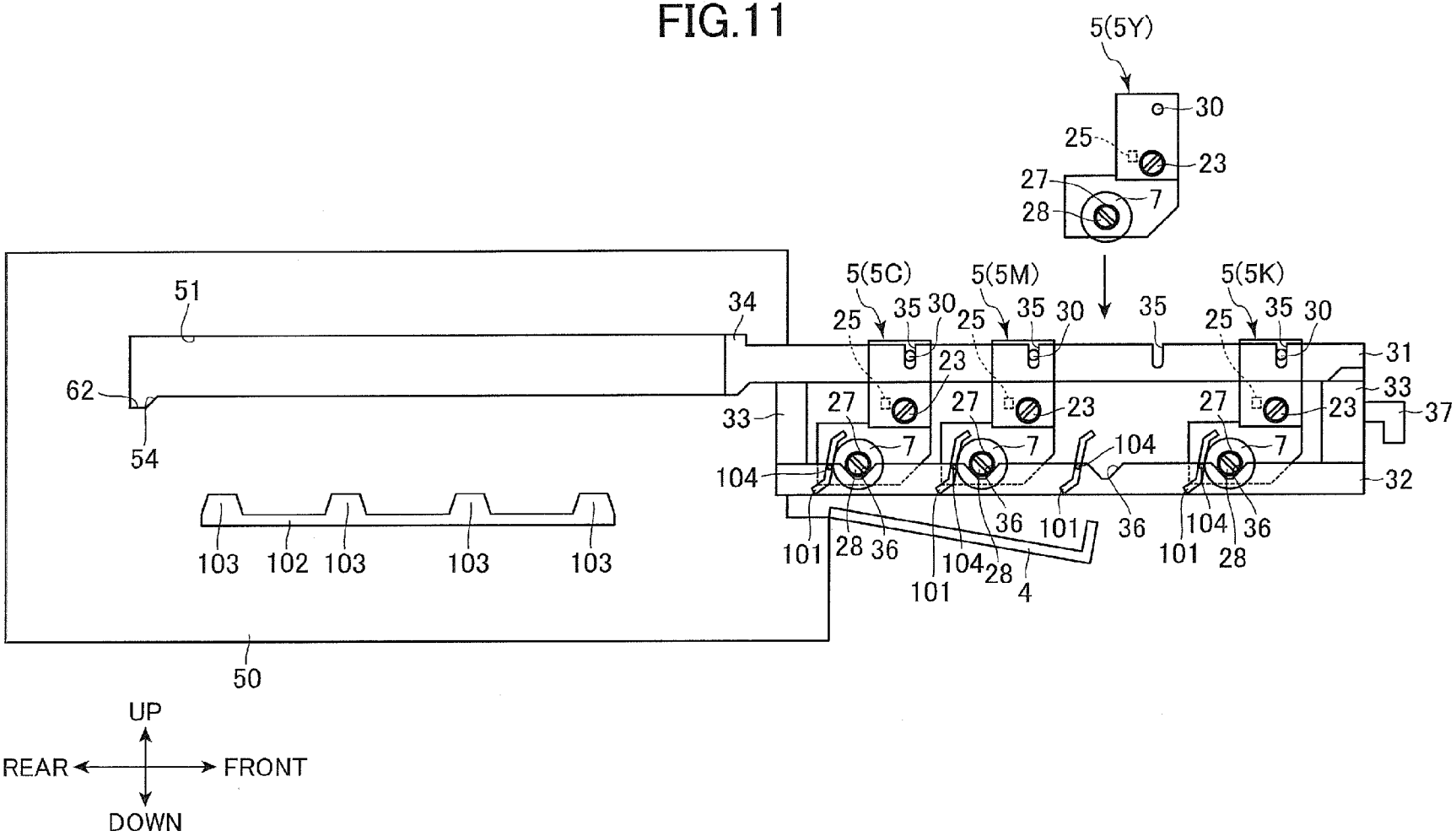
FIG. 11 is a side view showing a process unit which has been unloaded from a main unit of a color printer.

As shown in FIG. 11, the main unit 2 includes cam members 102 instead of the positioning members 52. Each cam member 102 is formed from a plate extending in the front-rear direction. Each cam member 102 overlaps with the lower end of each drum lock lever 101 in the width direction. In other words, the cam member 102 is positioned under the drum lock lever 101.

Figure 12:
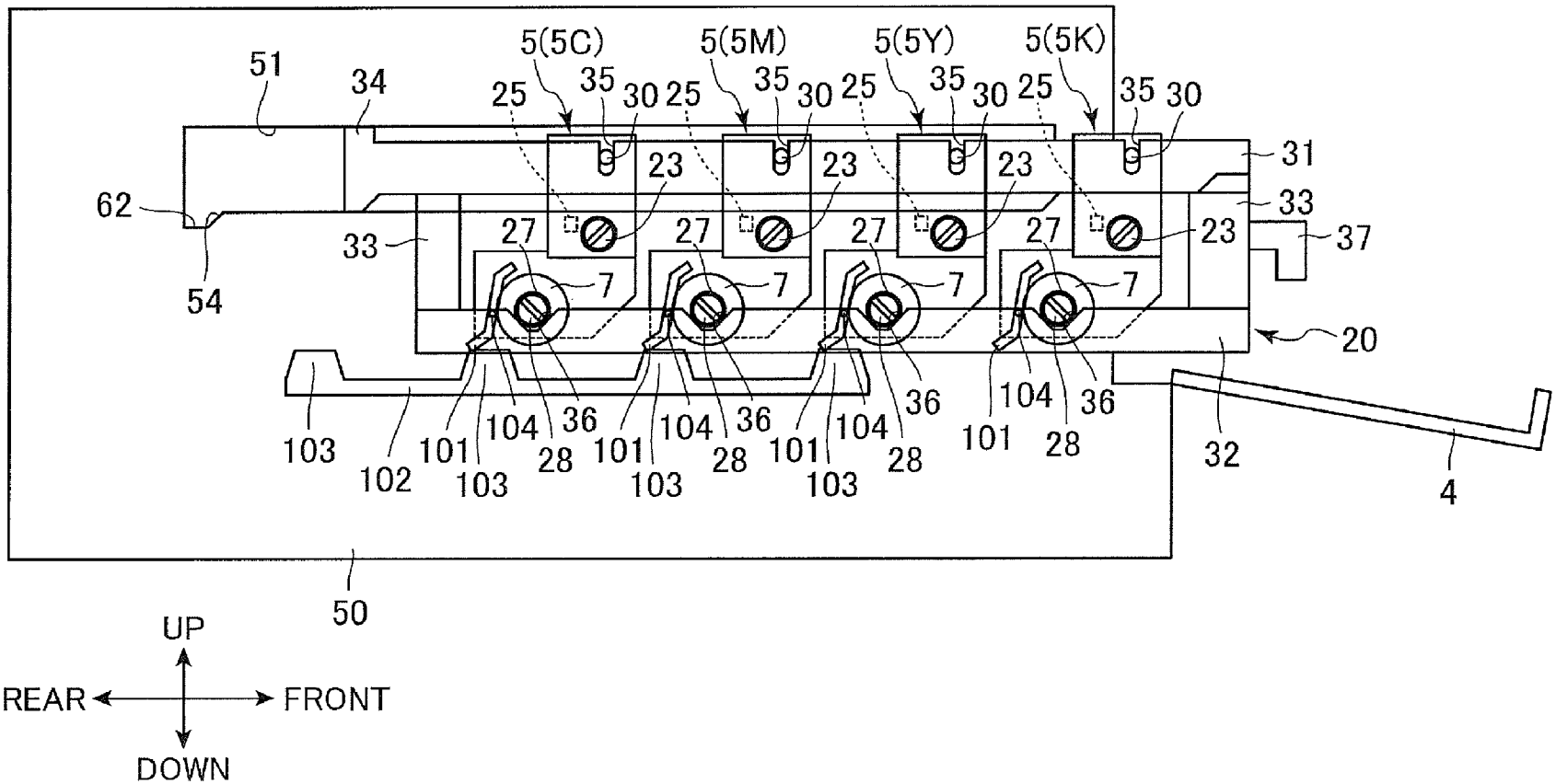
FIG. 12 is a side view showing a process unit which has been loaded in a main unit of a color printer.
Figure 13:
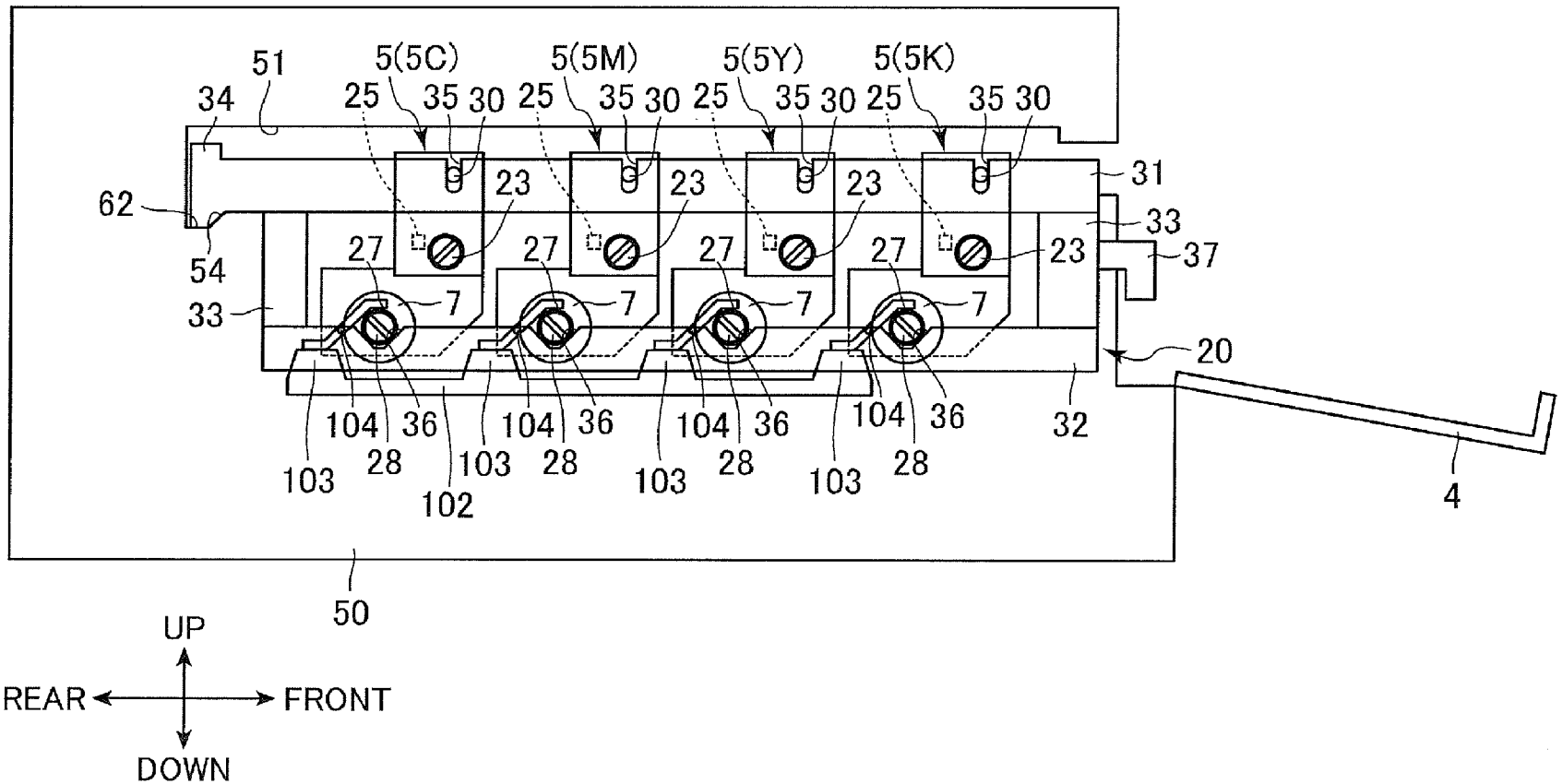
FIG. 13 is a side view showing a process unit loaded in a main unit of a color printer.
Figure 14:
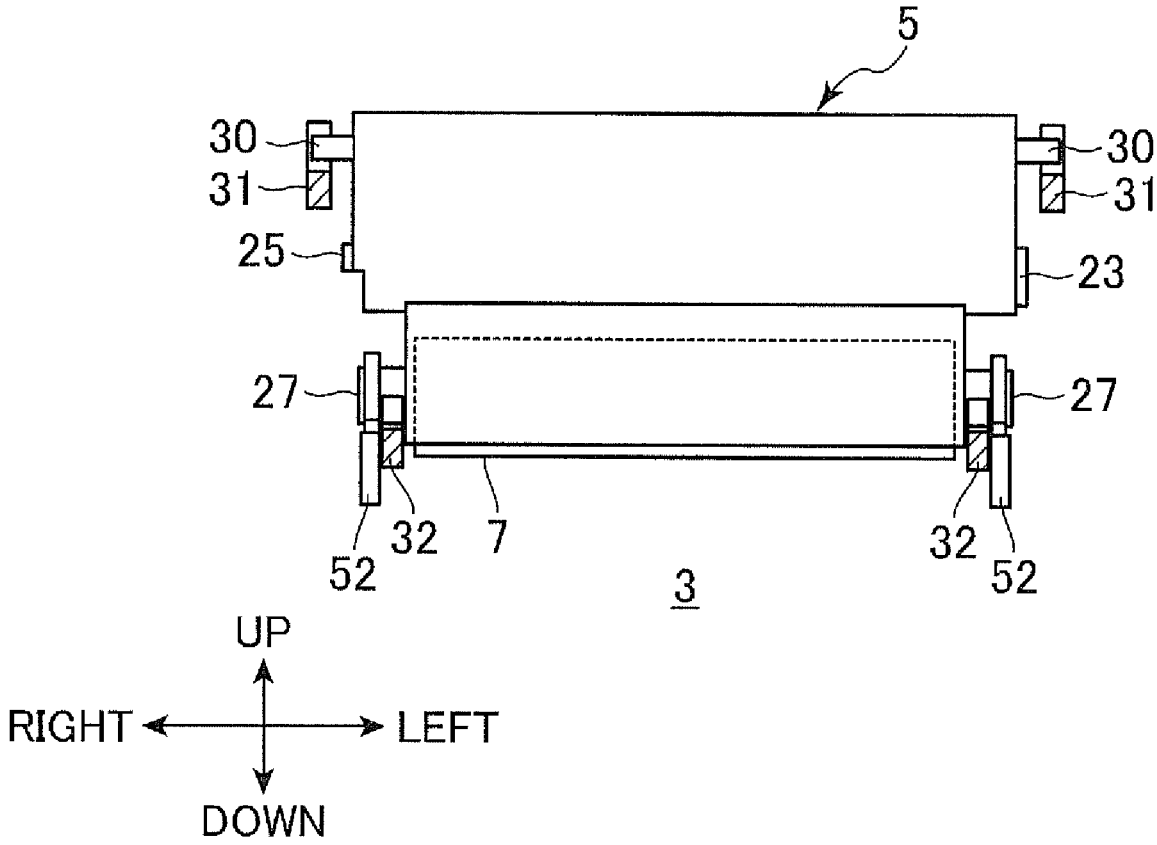
FIG. 14 is a back view showing the process unit of FIG. 13.

Each cam member 102 has four cam portions 103 formed into a substantial trapezoid as viewed from a side. The cam portions 103 are arranged at regular intervals in the front-rear direction. As shown in FIG. 12, the top face of each cam portion 103 does not interact with the corresponding drum lock lever 101, while the tandem-type process unit 3 is being loaded in or unloaded out of the main unit 2. As shown in FIG. 13, each cam portion 103 has a height so as to be in contact with the lower end of the drum lock lever 101 in the state that the tandem-type process unit 3 has been loaded in the main unit 2.

(3) Loading of Process Unit in Main Unit

As shown in FIG. 11, in the state that the tandem-type process unit 3 has been removed from the main unit 2, the drum lock lever 101 keeps standing erect almost in the vertical direction.

As the tandem-type process unit 3 moves to the rear from the position shown in FIG. 11, the stopper portion 34 of each upper supporting plate 31 slides along the guiding rail 51 so that the tandem-type process unit 3 is guided into the main unit 2 as shown in FIG. 12.

As the stopper portion 34 then moves downward to the rear along the inclined face 54 of the guiding rail 51, the tandem-type process unit 3 as a whole moves to one level lower downward to the rear, each drum lock lever 101 comes into contact with the corresponding cam portion 103 of each cam member 102 from above. When each drum lock lever 101 comes in contact with the corresponding cam portion 103, the drum lock lever 101 is rotated in the clockwise direction against the urging force applied in the counterclockwise direction.

As the stopper portion 34 then reaches the flat face 62 as shown in FIG. 13, the tandem-type process unit 3 moves to one more level lower downward to the rear. The drum lock lever 101 is further rotated in the clockwise direction due to the cam portion 103, so that one end of the drum lock lever 101 comes in contact with the corresponding projecting part 27 from above to press the corresponding projecting part 27 to the corresponding notch 36. The process cartridges 5 can thus be positioned with respect to the tandem-type process unit 3 stably and precisely.

As has been described above, when each drum lock lever 101 is operated by the corresponding cam portion 103 of the cam member 102, each projecting part 27 is supported and fixed to the corresponding lower supporting plate 32. Each projecting part 27 is supported and fixed to the corresponding notch 36 of the lower supporting plate 32, thereby positioning the respective process cartridges 5 to the lower supporting plates 32 accurately.

It is understood that the foregoing description and accompanying drawings set forth the embodiments of the invention at the present time. Various modifications, additions and alternative designs will, of course, become apparent to those skilled in the art in light of the foregoing teachings without departing from the spirit and scope of the disclosed invention. Thus, it should be appreciated that the invention is not limited to the disclosed embodiments but may be practiced within the full scope of the appended claims.

What is claimed is:

1. A tandem type of process unit removably loaded in an image forming device, comprising:

a plurality of process cartridges, each of the plurality of process cartridges having a photosensitive drum rotatably about an axis extending in a first direction, each of the plurality of process cartridges having two side faces facing each other in the first direction and a cartridge electrode provided on the side face, the plurality of process cartridges being aligned in a second direction perpendicular to the first direction;

a pair of lower supporting plates, each of the lower supporting plates supporting a lower part of the side face of each of the plurality of process cartridges; and a pair of upper supporting plates positioned upward and separately from the pair of lower supporting plates, each of the upper supporting plates supporting an upper part of the side face of each of the plurality of process cartridges, wherein the pair of upper support plates and the pair of lower support plates provide a side opening facing the side face of each of the plurality of process cartridges to expose the cartridge electrode of each of the plurality of process cartridges toward outside through the side opening.

2. The tandem type of process unit according to claim 1, wherein the pair of lower support plates is positioned at a first distance from each other, the pair of upper support plates is positioned at a second distance from each other, and the second distance is longer than the first distance.

3. The tandem type of process unit according to claim 2, wherein each of the pair of lower support plates has a lower inner surface, the first distance is a distance between the lower inner surfaces of the pair of lower support plates, each of the pair of upper support plates has an upper inner surface, and the second distance is a distance between the upper inner surfaces of the pair of upper support plates.

4. The tandem type of process unit according to claim 3, wherein each of the plurality of process cartridges comprises a pair of lower supported portions and a pair of upper supported portions positioned above the pair of lower supported portions, the pair of lower supported portions has lower end surfaces in the first direction and configured to be supported by the pair of lower support plates, the lower end surfaces being at a third distance from each other, and the third distance being longer than the first distance, and the third distance being shorter than the second distance, and the pair of upper supported portions has upper end surfaces in the first direction and configured to be supported by the pair of upper supporting plates, the upper end surfaces being at a fourth distance from each other, the fourth distance being longer than the second distance.

5. The tandem type of process unit according to claim 4, wherein one of the pair of lower supported portions is positioned on the axis for transferring a driving force to the photosensitive drum.

6. The tandem type of process unit according to claim 4, further comprising a lever configured to fix the lower supported portion to the lower support plate.

7. The tandem type of process unit according to claim 2, wherein the pair of lower support plates is positioned at a first center-to-center distance from each other, the pair of upper support plates is positioned at a second center-to-center distance from each other, and the second center-to-center distance is longer than the first center-to-center distance.

8. The tandem type of process unit according to claim 1, further comprising a joint plate having a width and a height configured to couple the pair of lower supporting plates to the pair of upper supporting plates.

9. The tandem type of process unit according to claim 8, wherein the joint plate comprises an upper portion and a middle portion, the upper portion has a first width in the first direction and two side ends to be coupled to the pair of upper support plates, the middle portion has a second width in the first direction, and the second width is shorter than the first width.

10. An image forming device, comprising:

a main unit; and a tandem type of process unit removably loaded in the main unit, wherein the tandem type of process unit further comprises:

a plurality of process cartridges, each of the plurality of process cartridges having a photosensitive drum rotatably about an axis extending in a first direction, each of the plurality of process cartridges having two side faces facing each other in the first direction and a cartridge electrode provided on the side face, the plurality of process cartridges being aligned in a second direction perpendicular to the first direction;

a pair of lower supporting plates, each of the lower supporting plates supporting a lower part of the side face of each of the plurality of process cartridges; and a pair of upper supporting plates positioned upward and separately from the pair of lower supporting plates, each of the upper supporting plates supporting an upper part of the side face of each of the plurality of process cartridges, and wherein the pair of upper support plates and the pair of lower support plates provide a side opening facing the side face of each of the plurality of process cartridges to expose the cartridge electrode of each of the plurality of process cartridges toward outside through the side opening.

11. The image forming device according to claim 10, wherein, the pair of lower support plates is positioned at a first distance from each other, the pair of upper support plates is positioned at a second distance from each other, and the second distance is longer than the first distance.

12. The image forming device according to claim 11, wherein each of the pair of lower support plates has a lower inner surface, the first distance is a distance between the lower inner surfaces of the pair of lower support plates, each of the pair of upper support plates has an upper inner surface, the second distance is a distance between the upper inner surfaces of the pair of upper support plates.

13. The image forming device according to claim 12, wherein each of the plurality of process cartridges comprises a pair of lower supported portions and a pair of upper supported portions positioned above the pair of lower supported portions, the pair of lower supported portions has lower end surfaces in the first direction and configured to be supported by the pair of lower support plates, the lower end surfaces being at a third distance from each other, and the third distance being longer than the first distance, and the third distance being shorter than the second distance, and the pair of upper supported portions has upper end surfaces in the first direction and configured to be supported by the pair of upper supporting plates, the upper end surfaces being at a fourth distance from each other, the fourth distance being longer than the second distance.

14. The image forming device according to claim 13, wherein one of the pair of supported portions is positioned on the axis for transferring a driving force to the photosensitive drum.

15. The image forming device according to claim 13, further comprising a lever configured to fix the lower supported portion to the lower support plate, and the main unit has an operating member to operate the lever.

16. The image forming device according to claim 13, further comprises a positioning member configured to support the plurality of process cartridges and position the plurality of process cartridges to predetermined positions in the main unit.

17. The image forming device according to claim 10, further comprising a joint plate having a width and a height configured to couple the pair of lower supporting plates to the pair of upper supporting plates.

18. The image forming device according to claim 17, wherein the joint plate comprises an upper portion and a middle portion, the upper portion has a first width in the first direction and two side ends to be coupled to the pair of upper support plates, the middle portion has a second width in the first direction, and the second width is shorter than the first width.

19. The image forming device according to claim 10, wherein the main unit further includes a main unit electrode configured to connect to the cartridge electrode and transfer electric power thereto, a connected portion of the main unit electrode and the cartridge electrode is inside of the inner surface of the upper support plate in the first direction.

20. A tandem type of process unit removably loaded in an image forming device, comprising:

a plurality of process cartridges, each of the plurality of process cartridges having a photosensitive drum rotatably about an axis extending in a first direction, each of the plurality of process cartridges having two side faces facing each other in the first direction, the plurality of process cartridges being aligned in a second direction perpendicular to an axial direction;

a pair of lower supporting plates, each of the lower supporting plates supporting and positioning a lower part of the side face of each of the plurality of process cartridges; and a pair of upper supporting plates positioned separately and upward from the pair of lower supporting plates, each of the upper supporting plates supporting and positioning an upper part of the side face of each of the plurality of process cartridges.

21. A tandem type of process unit comprising:

a plurality of process cartridges, each of the plurality of process cartridges having a photosensitive drum rotatably about an axis extending in a first direction, each of the plurality of process cartridges having two side faces facing each other in the first direction and a cartridge electrode provided on the side face, the plurality of process cartridges being aligned in a second direction perpendicular to the first direction;

a pair of lower supporting plates, each of the lower supporting plates supporting a lower part of the side face of each of the plurality of process cartridges; and a pair of upper supporting plates positioned upward and separately from the pair of lower supporting plates, each of the upper supporting plates supporting an upper part of the side face of each of the plurality of process cartridges, wherein the pair of upper support plates and the pair of lower support plates provide a side opening facing the side face of each of the plurality of process cartridges to expose the cartridge electrode of each of the plurality of process cartridges toward outside through the side opening.

22. The tandem type of process unit according to claim 21, wherein the pair of lower support plates is positioned at a first distance from each other, the pair of upper support plates is positioned at a second distance from each other, and the second distance is longer than the first distance.

23. The tandem type of process unit according to claim 22, wherein each of the pair of lower support plates has a lower inner surface, the first distance is a distance between the lower inner surfaces of the pair of lower support plates, each of the pair of upper support plates has an upper inner surface, and the second distance is a distance between the upper inner surfaces of the pair of upper support plates.

24. The tandem type of process unit according to claim 22, wherein the pair of lower support plates is positioned at a first center-to-center distance from each other, the pair of upper support plates is positioned at a second center-to-center distance from each other, and the second center-to-center distance is longer than the first center-to-center distance.

25. The tandem type of process unit according to claim 23, wherein each of the plurality of process cartridges comprises a pair of lower supported portions and a pair of upper supported portions positioned above the pair of lower supported portions, the pair of lower supported portions has lower end surfaces in the first direction and configured to be supported by the pair of lower support plates, the lower end surfaces being at a third distance from each other, and the third distance being longer than the first distance, and the third distance being shorter than the second distance, and the pair of upper supported portions has upper end surfaces in the first direction and configured to be supported by the pair of upper supporting plates, the upper end surfaces being at a fourth distance from each other, the fourth distance being longer than the second distance.

26. The tandem type of process unit according to claim 25, wherein one of the pair of lower supported portions is positioned on the axis for transferring a driving force to the photosensitive drum.

27. The tandem type of process unit according to claim 25, further comprising a lever configured to fix the lower supported portion to the lower support plate.

28. The tandem type of process unit according to claim 21, further comprising a joint plate having a width and a height configured to couple the pair of lower supporting plates to the pair of upper supporting plates.

29. The tandem type of process unit according to claim 28, wherein the joint plate comprises an upper portion and a middle portion, the upper portion has a first width in the first direction and two side ends to be coupled to the pair of upper support plates, the middle portion has a second width in the first direction, and the second width is shorter than the first width.

30. An image forming device, comprising:

a main unit; and a tandem type of process unit configured to be loaded in the main unit, wherein the tandem type of process unit further comprises:

a plurality of process cartridges, each of the plurality of process cartridges having a photosensitive drum rotatably about an axis extending in a first direction, each of the plurality of process cartridges having two side faces facing each other in the first direction and a cartridge electrode provided on the side face, the plurality of process cartridges being aligned in a second direction perpendicular to the first direction;

a pair of lower supporting plates, each of the lower supporting plates supporting a lower part of the side face of each of the plurality of process cartridges; and a pair of upper supporting plates positioned upward and separately from the pair of lower supporting plates, each of the upper supporting plates supporting an upper part of the side face of each of the plurality of process cartridges, and wherein the pair of upper support plates and the pair of lower support plates provide a side opening facing the side face of each of the plurality of process cartridges to expose the cartridge electrode of each of the plurality of process cartridges toward outside through the side opening.

31. The image forming device according to claim 30, wherein, the pair of lower support plates is positioned at a first distance from each other, the pair of upper support plates is positioned at a second distance from each other, and the second distance is longer than the first distance.

32. The image forming device according to claim 31, wherein each of the pair of lower support plates has a lower inner surface, the first distance is a distance between the lower inner surfaces of the pair of lower support plates, each of the pair of upper support plates has an upper inner surface, the second distance is a distance between the upper inner surfaces of the pair of upper support plates.

33. The image forming device according to claim 32, wherein each of the plurality of process cartridges comprises a pair of lower supported portions and a pair of upper supported portions positioned above the pair of lower supported portions, the pair of lower supported portions has lower end surfaces in the first direction and configured to be supported by the pair of lower support plates, the lower end surfaces being at a third distance from each other, and the third distance being longer than the first distance, and the third distance being shorter than the second distance, and the pair of upper supported portions has upper end surfaces in the first direction and configured to be supported by the pair of upper supporting plates, the upper end surfaces being at a fourth distance from each other, the fourth distance being longer than the second distance.

34. The image forming device according to claim 33, wherein one of the pair of supported portions is positioned on the axis for transferring a driving force to the photosensitive drum.

35. The image forming device according to claim 33, further comprising a lever configured to fix the lower supported portion to the lower support plate, and the main unit has an operating member to operate the lever.

36. The image forming device according to claim 33, further comprises a positioning member configured to support the plurality of process cartridges and position the plurality of process cartridges to predetermined positions in the main unit.

37. The image forming device according to claim 30, further comprising a joint plate having a width and a height configured to couple the pair of lower supporting plates to the pair of upper supporting plates.

38. The image forming device according to claim 37, wherein the joint plate comprises an upper portion and a middle portion, the upper portion has a first width in the first direction and two side ends to be coupled to the pair of upper support plates, the middle portion has a second width in the first direction, and the second width is shorter than the first width.

39. The image forming device according to claim 30, wherein the main unit further includes a main unit electrode configured to connect to the cartridge electrode and transfer electric power thereto, a connected portion of the main unit electrode and the cartridge electrode is inside of the inner surface of the upper support plate in the first direction.

40. A tandem type of process unit comprising:

a plurality of process cartridges, each of the plurality of process cartridges having a photosensitive drum rotatably about an axis extending in a first direction, each of the plurality of process cartridges having two side faces facing each other in the first direction, the plurality of process cartridges being aligned in a second direction perpendicular to an axial direction;

a pair of lower supporting plates, each of the lower supporting plates supporting and positioning a lower part of the side face of each of the plurality of process cartridges; and a pair of upper supporting plates positioned separately and upward from the pair of lower supporting plates, each of the upper supporting plates supporting and positioning an upper part of the side face of each of the plurality of process cartridges.

* * * * *